US010021911B2

(12) United States Patent
Xu

(10) Patent No.: US 10,021,911 B2
(45) Date of Patent: Jul. 17, 2018

(54) DISPOSABLE CARTRIDGE WITH RESEALABLE TRAPDOOR

(71) Applicant: Yongjie James Xu, Richmond, VA (US)

(72) Inventor: Yongjie James Xu, Richmond, VA (US)

( * ) Notice: Subject to any disclaimer, the term of this patent is extended or adjusted under 35 U.S.C. 154(b) by 0 days.

(21) Appl. No.: 15/274,713

(22) Filed: Sep. 23, 2016

(65) Prior Publication Data

US 2018/0084830 A1 Mar. 29, 2018

(51) Int. Cl.

| | |
|---|---|
| ***A24F 25/00*** | (2006.01) |
| ***A24F 47/00*** | (2006.01) |
| ***B65D 25/54*** | (2006.01) |
| ***B65D 85/00*** | (2006.01) |

(52) U.S. Cl.
CPC ..... *A24F 47/008* (2013.01); *B65D 25/54* (2013.01); *B65D 85/54* (2013.01)

(58) Field of Classification Search
CPC ..... A24F 47/008; B65D 25/54; B65D 85/54
USPC ..... 131/329
See application file for complete search history.

(56) References Cited

U.S. PATENT DOCUMENTS

| | | | | |
|---|---|---|---|---|
| 8,156,944 | B2 * | 4/2012 | Han | A24F 47/008 131/273 |
| 9,010,335 | B1 * | 4/2015 | Scatterday | A24F 47/008 128/202.21 |
| 9,750,284 | B2 * | 9/2017 | Rado | A24F 47/008 |
| 9,877,520 | B2 * | 1/2018 | Rastogi | A24F 47/008 |
| 2018/0049475 | A1 * | 2/2018 | Memari | H02J 50/10 |

* cited by examiner

*Primary Examiner* — Khiem Nguyen
(74) *Attorney, Agent, or Firm* — Nixon & Vanderhye P.C.

(57) ABSTRACT

A resealable disposable microvaporizer cartridge having an outer casing and an inner casing that is radially inwards of the outer casing, a trapdoor, and a tank defined between a radially inward surface of the outer casing and a radially outward surface of the inner casing. The cartridge is sealed by the trapdoor on one end, and the trapdoor is resealable. A disposable mouthpiece can also be provided on the disposable cartridge.

14 Claims, 16 Drawing Sheets

DISPOSABLE CARTRIDGE WITH RESEALABLE TRAPDOOR

This application claims the benefit of U.S. provisional patent application 63/348,205, filed on Jun. 10, 2016, the entirety of which is hereby incorporated by reference herein.

This invention relates to a single-use disposable cartridge for a microvaporizer, in particular a single-use disposable cartridge having a resealable trapdoor over the fluid opening of the fluid storage tank.

BACKGROUND OF THE INVENTION

A microvaporizer, such as an e-cigarette, includes a mouthpiece, a heating element (also called an "atomizer"), a tank, and a battery. The e-cigarette is typically cylindrical. The tank stores liquids that would be vaporized by the atomizer to create vapor for a user, also called an "e-liquid". The atomizer is typically a heating coil that is put in contact with the e-liquid when vapors are desired. Commercially, the tank is a permanent and refillable part of the microvaporizer. The tank is typically attached to the atomizer on one end, and attached to the body of the vaporizer, including a battery portion on the opposite end. The tank is further attached to the mouthpiece. Some of the commercial tanks also include the heating coil inside a portion of the tank for vaporization of the e-liquid stored in the tank.

The tank includes an outer casing that forms the exterior surface of the tank, and an inner casing that defines a middle air passage in the center of the tank. The e-liquid is stored in the surrounding chamber, which is located in between the outer casing and the inner casing of the tank.

The conventional tank poses several inconveniences to a user. The conventional tank is refilled by adding e-liquid to the surrounding chamber using a dripper or squeeze bottle. It is important that the user only fills the surrounding chamber in the tank, and to avoid adding e-liquid to the middle air passage. If the e-liquid were added to the middle air passage, then the user would likely taste the e-liquid in the mouthpiece. A dripper or squeeze bottle is needed to refill the e-liquid into the surrounding chamber because the opening to the surrounding chamber is very small. The user would need to tilt the tank for a more accurate access to the surrounding chamber when refilling the tank.

Furthermore, if the user would like to use the e-cigarette outside of the home, the user would need to carry an additional bottle of e-liquid with a dripper, or inside a squeeze bottle, as well as the e-cigarette in order to refill the e-cigarette while traveling. It would be difficult for the user to refill if there is no steady light and/or surface for the user to perform the delicate act of refilling the surrounding tank on the go.

An attempt to provide a disposable cartridge has been disclosed in U.S. Pat. No. 8,910,639, in which the smoking article includes a control body that houses the battery, and a disposable cartridge that is detachably connected to the control body. The cartridge includes a resistive heating element and storage of a product for vaporization. By including a resistive heating element, the cost of the disposable cartridge in the '639 patent may be high due to the complexity of the components in the cartridge during manufacturing. Furthermore, the retail price may also be high because the resistive heating element is costly. A resistive heating element has a longer usage life than the liquid product in the tank. For most instances, the resistive heating element may still be reusable when the liquid needs to be refilled. Thus, it is desirable to provide an improved disposable cartridge that will be easy to use and replace, cheaper to manufacture, and simplified to lower the retail price for the consumers.

The disposable, pre-filled cartridge system will make it tamper proof for user.

BRIEF SUMMARY OF THE INVENTION

The single use disposable resealable microvaporizer cartridge described herein attempts to improve the inconveniences of the conventional method that requires an user to refill the tank, by providing a pre-filled, non-refillable cartridge that is easily removable and replaceable from the e-cigarette no matter where the user may be located. The disposable cartridge does not include an atomizer, such that manufacturing cost of the disposable cartridge can be reduced, and the retail price of the cartridge can also be reduced. In addition, the disposable cartridge includes a resealable trapdoor that allows easy replacement of the cartridges with a reduced potential of fluid leakage during the replacement process, and allows the user to be able to switch between different cartridges, such as to switch between different cartridges that have different flavored stored fluids for vaporization.

An embodiment of the disposable microvaporizer cartridge having a resealable trapdoor includes an outer casing, an inner casing that is radially inwards of the outer casing, a fluid opening on the inner casing, and a tank defined between the outer casing and the inner casing to store fluids that can be extracted from the tank through the fluid opening, and a resealable trapdoor positioned over the fluid opening.

When the resealable and disposable microvaporizer cartridge is fully engaged with a microvaporizer, the microvaporizer includes a battery, an atomizer connected to the battery, a mouthpiece, and a disposable resealable cartridge connected in between the atomizer and the mouthpiece, the cartridge has an outer casing, an inner casing, a tank defined in between the outer casing and the inner casing, a liquid opening on the inner casing that engages with the atomizer on the second end of the cartridge, and a resealable trapdoor that is positioned over the liquid opening.

DETAILED DESCRIPTION OF THE INVENTION

The present invention provides a single-use disposable and resealable cartridge for a microvaporizer, such as an e-cigarette, that is easy to replace for fluid refill to the microvaporizer. The single use cartridge allows the user to replace only the tank portion using a prefilled cartridge. The user would not need to manually refill the e-cigarette with bottled liquid using droppers or squeeze bottles. Instead, a user can simply remove the entire cartridge from the vaporizer, keeping the atomizer intact in the microvaporizer, and substitute another prefilled cartridge in place of the previous cartridge.

To reduce manufacturing cost, the embodiment cartridge does not include an atomizer which typically has a longer lifetime than the stored fluids in the cartridge. The cartridge includes a resealable trapdoor that is positioned over the liquid openings in the cartridge. The resealable trapdoor prevents fluid leakage during the cartridge replacement process, and allows the user to engage and disengage the cartridge easily in a single step. In addition, the resealable trapdoor allows a user to switch between cartridges before the fluid is depleted in each cartridge, such as for different flavors stored in the different cartridges, because the seal or trapdoor engages automatically to reseal the cartridge when it is disengaged from the microvaporizer and prevents leakage of the fluid content during the switch. The automatic resealable trapdoor can be a spring mechanism or can be a lock-and-twist mechanism, for example. Other similar mechanisms that have the capability to engage and disengage the trapdoor over the fluid opening can also be used.

Figure 1:
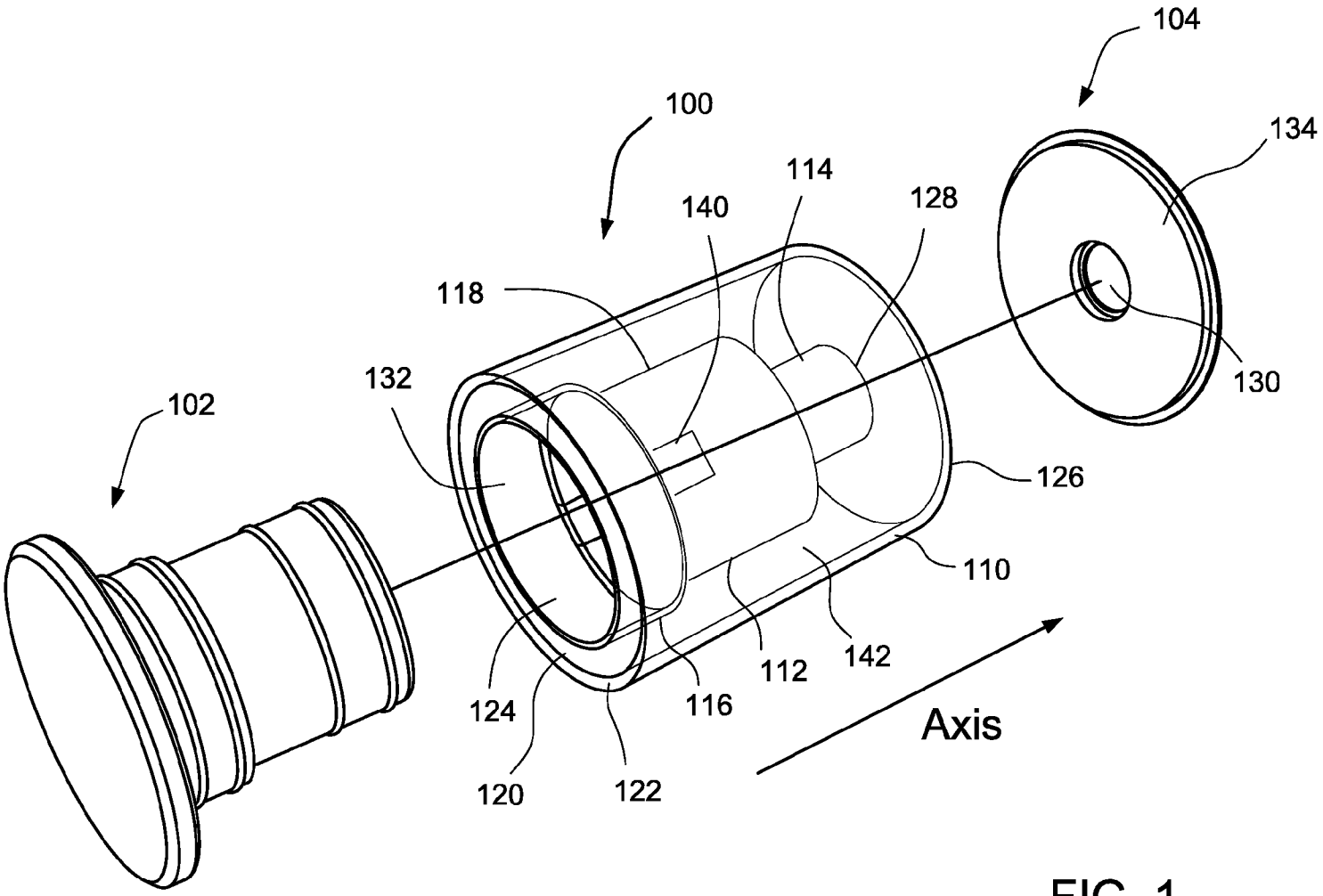
FIG. 1 is an exploded view of a first embodiment cartridge that is sealed by a plug for shipment.

FIG. 1 is a schematic drawing of a blown-up view of the first embodiment cartridge 100 with a trapdoor 104 and a plug 102. The trapdoor 104 can be resealable. The cartridge 100 includes an outer casing 110 and an inner casing 112. The outer casing 110 provides the exterior surface of the cartridge 100 that is exposed to the atmosphere. The inner casing 112 provides an inner surface that is exposed to the inner flow passage of the microvaporizer when the cartridge 100 is connected to the body of the microvaporizer.

A tank 142 is provided between the outer casing 110 and inner casing 112. The tank 142 stores the liquid to be vaporized. The volume of the tank 142 is defined by the shapes of the outer casing 110 and the inner casing 112. The outer casing 110 may be cylindrical, rectangular, conical, or a mixture there of. The shape of the inner casing 112 may correspond to the shape of the outer casing 110, or may be modified to accommodate different sizes of atomizers in the commercial microvaporizers.

In the embodiment shown in FIG. 1, a first edge 122 of the outer casing 110 and the first edge 124 of the inner casing 112 defines a circular surface 120 that encloses the tank 142 from the first edge 122 of the outer casing 110 to the first edge 124 of the inner casing 112.

The first edge 124 of the inner casing 112 also defines an opening to the flow passage 132 that is radially inwards from the first edge 124. The flow passage 132 extends along an inner surface of the inner casing 112 through the cartridge 100 in an axial direction of the cartridge 100. A second edge 126 of the outer casing 110 and a second edge 128 of the inner casing define a circular surface that encloses the tank 142 in between the second edge 126 of the outer casing 110 and the second edge of the inner casing 112.

Alternatively, a trapdoor 104 can be used to enclose the tank 142 along the second edges 126, 128 of the outer casing 110 and the inner casing 112, respectively, using the inner surface 134 of the trapdoor 104, and leaving an opening 130 that is radially inwards of the second edge 128 of the inner casing 112. The opening 130 is provided to correspond with the flow passage 132.

The inner casing 112 may be shaped accordingly to fit an atomizer of a conventional microvaporizer, such as shown in FIG. 1 by modifying the shape of the first section 116 of the inner casing 112 and a second section 112 of the inner casing 112. The third section 114 of the inner casing 112 typically does not abut an atomizer. Thus, the inner casing 112 can be shaped differently depending on the shape of the conventional microvaporizer and its atomizer that the cartridge 100 is to be connected to.

In the embodiment in FIG. 1, the inner casing 112 is shaped such that the first section 116 has the largest diameter, the second section 118 has a smaller diameter than the first section 116, and the third section 114 has the smallest diameter to accommodate an atomizer in the first and second sections 116, 118. In the second section 118, a liquid opening 140 is provided on the inner casing 112 to allow liquids to flow from the tank 142 to the atomizer that abuts the inner surface of the inner casing 112 in the flow path 132. The liquid opening 140 is depicted in FIG. 1 as a rectangular window. Alternatively, the liquid opening 140 may be circular, triangular, octagonal, or similar, to fit the desired optimal flow rate of the liquid that is provided to an atomizer for vaporization.

In order to retain the liquid in the tank 142 during shipment and prior to engaging the cartridge 100 to a microvaporizer, a plug 102 may be used as a temporary seal to enclose the liquid opening 140 on the radially inner surface of the inner casing 112. The plug 102 may be shaped such that when inserted into the cartridge 100, the plug 102 fits snuggly against the perimeter of the flow passage 132.

The plug 102 may be a solid piece or may be hollow. The plug 102 may be made of silicon, rubber, or other like materials.

The cartridge 100 can be made of a plastic material, a resin material, or other like materials. The cartridge 100 is typically cylindrical shaped, but can be shaped differently as needed to fit the body of different commercial microvaporizers.

Figure 2A:
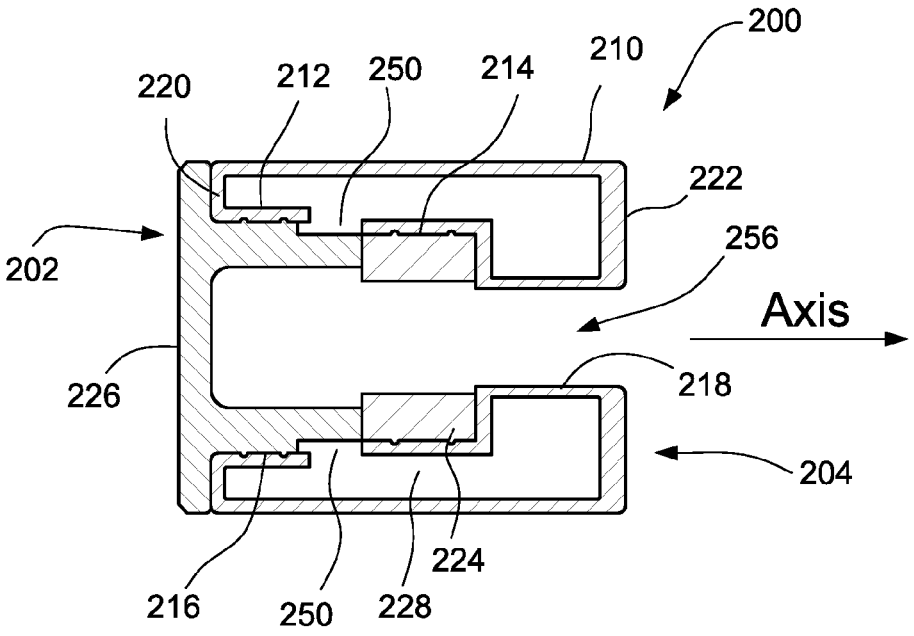
FIG. 2A is a schematic cross-section of the first embodiment cartridge with a plug.

A schematic cross-sectional view of an embodiment cartridge 200 is provided in FIG. 2A. Cartridge 200 is sealed on a first end 202 along the axis by a plug 226. The cartridge 200 includes an outer casing 210 that forms the exterior surface of the cartridge 200, and an inner casing 212 that forms the flow path that is radially inwards of the inner casing 212. Along the first end, the cartridge 200 is sealed by a circular surface 220 along the outer circumference of the cartridge 200. The outer perimeter of plug 226 may be shaped to fit snuggly against the inner surface of the inner casing. The plug 226 blocks the liquid opening 250 to prevent fluid leakage from the tank 228.

On the opposite end of the cartridge 200 from the plug 226, which is the second end 204 of the cartridge 200 along the axis of the cartridge, the tank 228 is sealed between the edges of the outer casing 210 and the inner casing 212. The circular surface 222 encloses the tank 228 on the second end 204 except for an opening of the flow path 252 that is a through passage that extends through the radially inner portion of the cartridge 200, along the axis of the cartridge.

As an example of how an inner casing can be reshaped, in FIG. 2, the inner casing 212 includes a first section 216, a liquid opening 250, a second section 214, and a third section 218. The first section 216 has a larger diameter than the second section 214 or third section 218. The second section 214 is larger in diameter than the third section 218, and is smaller in diameter than the first section 216. The plug 226 is formed to fit snugly with the first section 216 and the second section 214, such that the opening 250, which is situated in between the first section 216 and the second section 214, is temporarily sealed by the plug 226 during shipment.

The plug 216 may include grooves on its insertion portion that fit into pre-formed grooves provided on the radially inward surface on the first section 216 and the second section 218 of the inner casing 212. The pre-formed grooves ensure that the plug 216 would not be removed easily during shipment.

The cartridge 200 also includes a resealable trapdoor 224 that can seals the fluid opening 250 when the cartridge 200 is not engaged. In FIG. 2A, the resealable trapdoor 224 opens when it is engaged with the pug 226. For example, the resealable trapdoor 224 opens when the plug 226 is inserted into the cartridge 200. The plug 226 pushes the resealable trapdoor 224 in the axial direction into the open position. Similarly, the resealable trapdoor 224 is also pushed into the open position when the cartridge 200 is engaged with an atomizer that receives fluid from the cartridge 200. The resealable trapdoor 224 can be automatically moved back into position to seal the fluid opening 250 when the plug 226, or an atomizer, is disengaged from the cartridge 200.

Figure 2B:
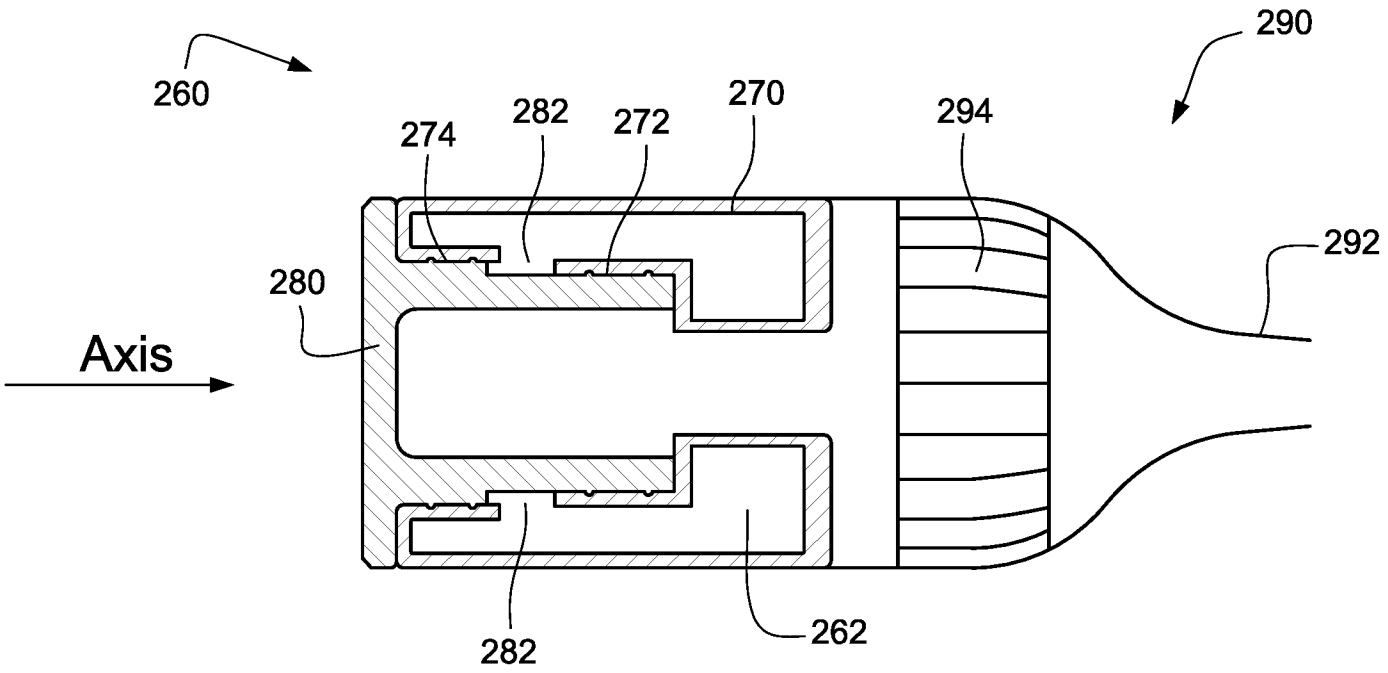
FIG. 2B is a schematic cross-section of the first embodiment cartridge having a disposable mouthpiece.

FIG. 2B provides an alternative embodiment that includes a disposable mouthpiece 290 attached to the cartridge 260. The cartridge 260 also includes an outer casing 270, an inner casing 274, and a tank 262 that is defined between the outer casing 270 and the inner casing 274. The inner casing may have some grooves 272 that ensures snug fit between the plug 280 and the inner casing 274 during transport, such that liquid inside the tank 262 would not leak through the liquid openings 282 on the inner casing 274. The disposable cartridge 260 includes a mouthpiece 290 with a mouthpiece opening 292. The mouthpiece 290 can have a membrane 294, e.g., filter, fiber bundles or other porous structure, on the inside of the mouthpiece 290. The cartridge 260 is not shown with a resealable trapdoor, but a resealable trapdoor can also be implemented in this embodiment.

Figure 3:
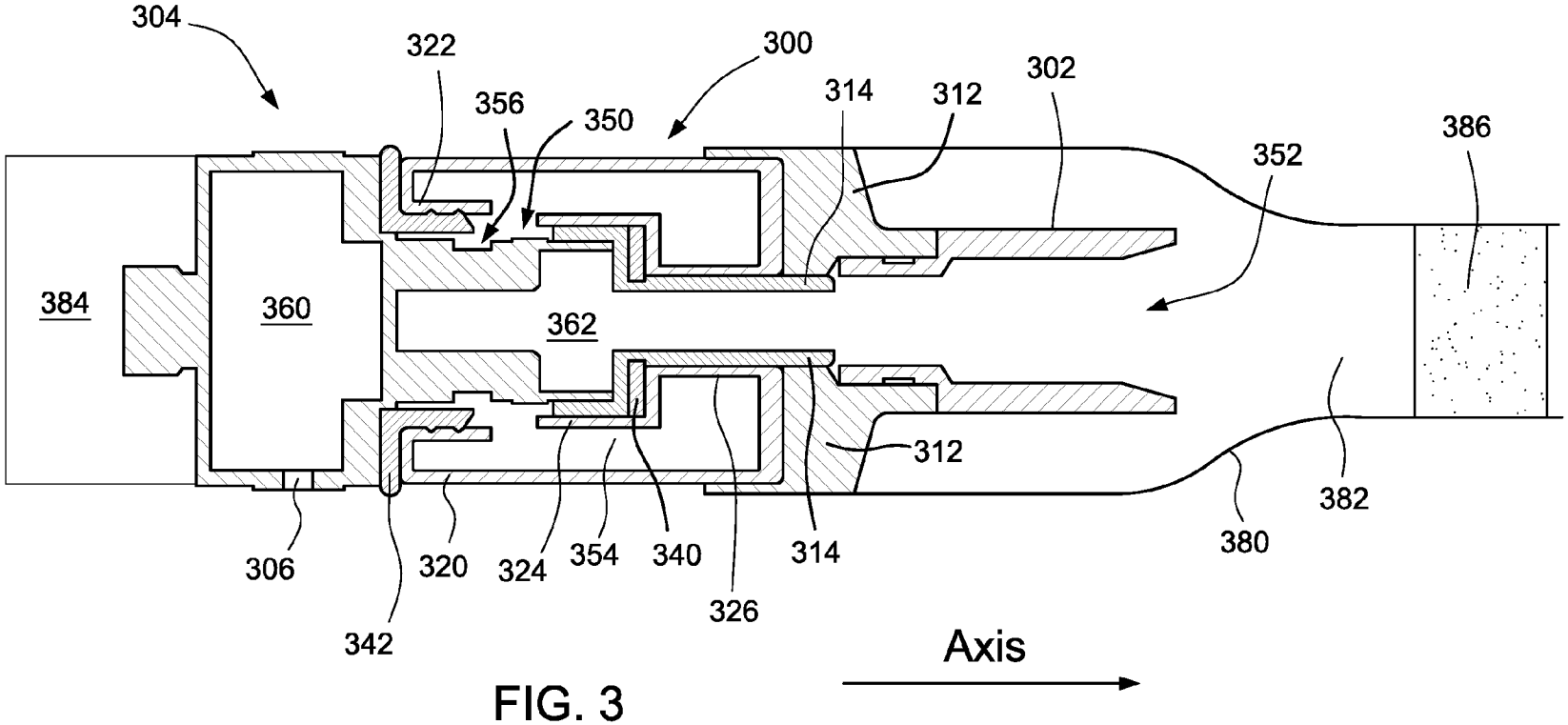
FIG. 3 is a schematic cross-section of the first embodiment cartridge that is engaged in a microvaporizer.

An example of how the embodiment cartridge can be engaged in a microvaporizer is shown in FIG. 3. A cartridge 300 is shown to connect in between a mouthpiece 380 and an atomizer 304 of a microvaporizer.

The atomizer may be connected directly to a battery 384. The atomizer 304 may be any commercial atomizers used in the existing microvaporizers. The atomizer 304 can be seen as two connected portions: the atomizer base 360 and the atomizer core 362. The atomizer base 360 connects to the cartridge 300 on a first end of the cartridge 300, and the atomizer base 360 may be directly connected to the battery 384. The first section 322 and the second section 324 of the inner casing are shaped such that the atomizer core 362 can be inserted into the flow path 352 on the radially inner portion of the cartridge 300.

The mouthpiece 380 is attached to the extended portion 302, and the vapor produced by the atomizer will escape the microvaporizer via mouthpiece opening 382 in the mouthpiece. The mouthpiece 380 may have a porous structure 386 that is situated in the mouthpiece opening 382. The porous structure 386 may be embedded with a flavor, such as menthol, a fruit taste or other flavor. The flavor may be a volatile or dissolvable composition embedded in the porous structure. The flavor imparts a taste to the vapor passing through the porous structure. The taste may cause a pleasant sensation in the mouth of the user.

In between the first section 322 and the second section 324 is a liquid opening 350 for the cartridge 300. The atomizer core 362 includes a liquid intake 356 that is substantially aligned with the liquid opening 350 of the cartridge 300 when the cartridge is fully engaged. During use, liquid from the tank 354 is drawn through the liquid opening 350 to flow into the liquid intake 356 of the atomizer core 362 for vaporization. The atomizer 304 also may include an air opening 306 that allows air flow for vaporization when the microvaporizer is in use.

FIG. 3 shows some exemplary retrofit parts to be applied to the atomizer to ensure that a commercial atomizer 304 would fit snugly to the cartridge 300 without liquid leakage. The first section 322 is engaged with a silicon connector 342 that is provided between the first end of the cartridge 300 and the atomizer base 360. The silicon connector 342 abuts the atomizer base 360 on the first end of the cartridge, and may fit into prefabricated grooves on the first section 322 of the cartridge 300. The atomizer base 360 may also include grooves that act as multiple seals when it is fitted onto the silicon connector 342.

The atomizer core 362 is also fitted with a stainless steel connector 314 that provides support to the atomizer 304 and the cartridge 300, such that the stainless steel connector 314 abuts the cartridge 300 on a radially outer surface, and abuts the atomizer core 362 on the radially inner surface. The stainless steel connector 314 extends from a first end that provides a connection between the atomizer core 362 and the second section 324 of the cartridge, towards a second end that is fitted along a radially inner surface of the third section 326, and the stainless steel connector 314 may extend beyond the length of the third section 326.

The portion of the stainless steel connector 324 that extends beyond the length of the third section 326 may include grooves that can be used to connect to a stainless steel cover 312. The stainless steel cover 312 fits over a portion of the cartridge 300 on a first end, and connects to a mouthpiece 302 on a second end. The stainless steel cover 312 may also have grooves on the second end to connect to the mouthpiece 302. The stainless steel connector 314, stainless steel cover 312 and the mouthpiece 302 are hollow, and the radially inner surfaces define a flow passage 352 to allow vapor to escape from the microvaporizer.

To further ensure that the stainless steel connector 314 is snugly fitted to the radially inner surfaces of the second section 324 and third section 326 of the inner casing, a silicon seal 340 may also be provided to fit between the stainless steel connector 314 and the radially inner surface of the inner casing that abuts the stainless steel connector 314. The silicon seal 340 may be in the form of a silicon or rubber gasket.

Figure 4A:
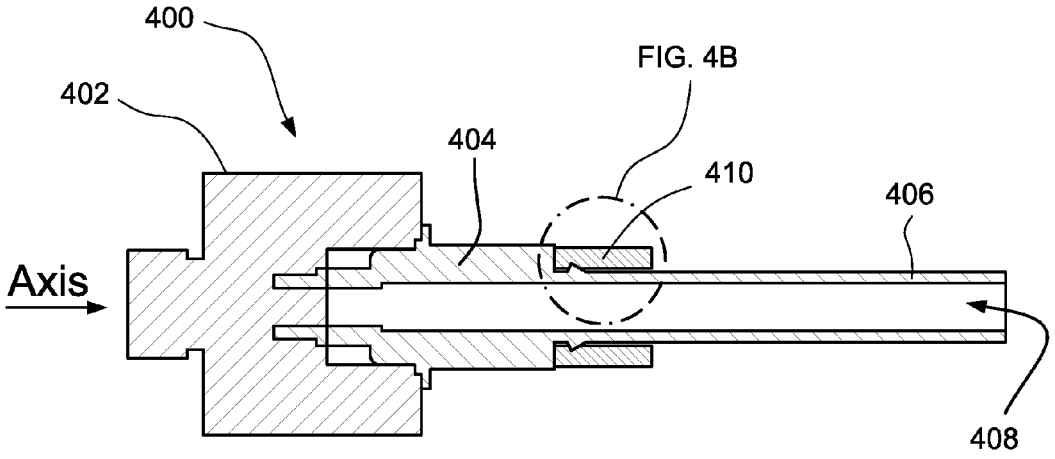
FIG. 4A is a schematic cross-sectional drawing of an atomizer having a seal attached.
Figure 4B:
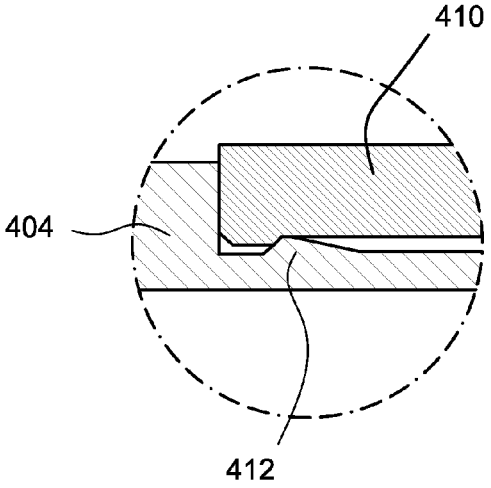
FIG. 4B is a detailed view showing the engagement of the seal on the atomizer.
Figure 5A:
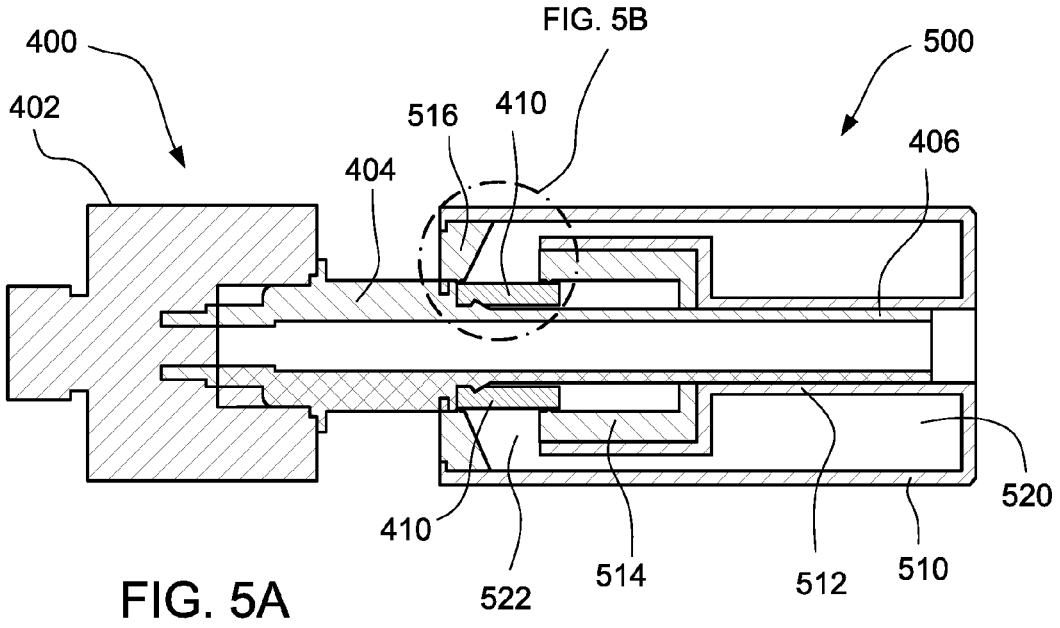
FIG. 5A is a schematic cross-sectional drawing of a third embodiment cartridge that is partly engaged to an atomizer with a seal at an initial position.
Figure 5B:
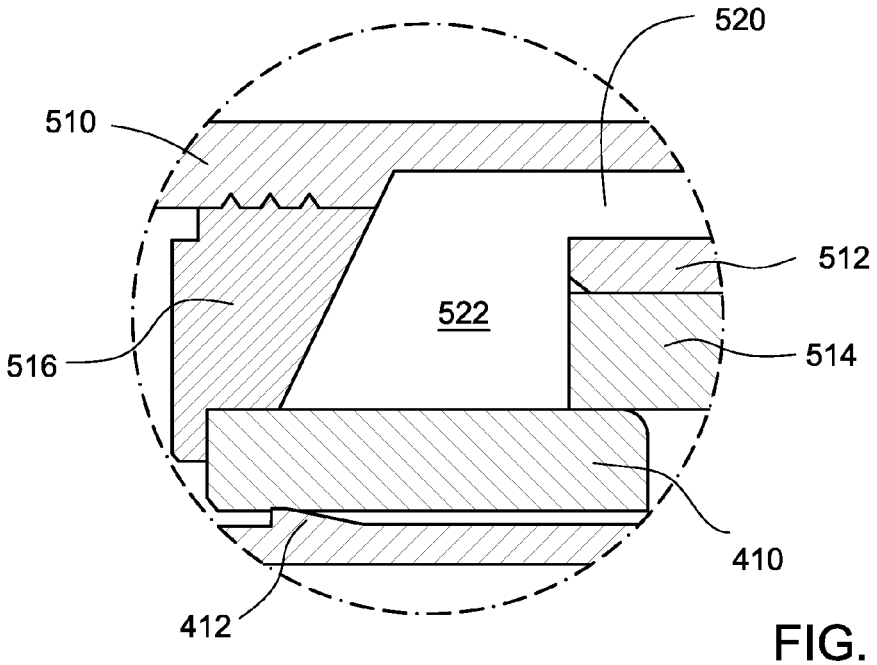
FIG. 5B is a detailed cross-sectional view of the seal at the initial position in the third embodiment cartridge.

For the type of atomizer 400 as shown in FIGS. 4A and 4B, a seal 410 can be employed to connect to an embodiment cartridge that fits over the connector core 404 and the conduit 406. The conduit 406, connected to the connector core 404, defines a flow passage 408 that allows vapor to escape. The seal 410 is provided on the conduit 406, abutting the connector core 404. The seal 410 is fitted over a protrusion 412 on the radially outer surface of the conduit 406, such that the seal 410 is secured in position.

When the atomizer 400 with a seal 410 is engaged with an embodiment cartridge, such as shown in 5A and 5B, the conduit 406 fits through the embodiment cartridge 500 and acts as a flow passage that can be further attached to a mouthpiece. The seal 410 fits into the cartridge 500 such that the seal 410 is aligned with a liquid opening 522 on the cartridge 500.

Figure 6:
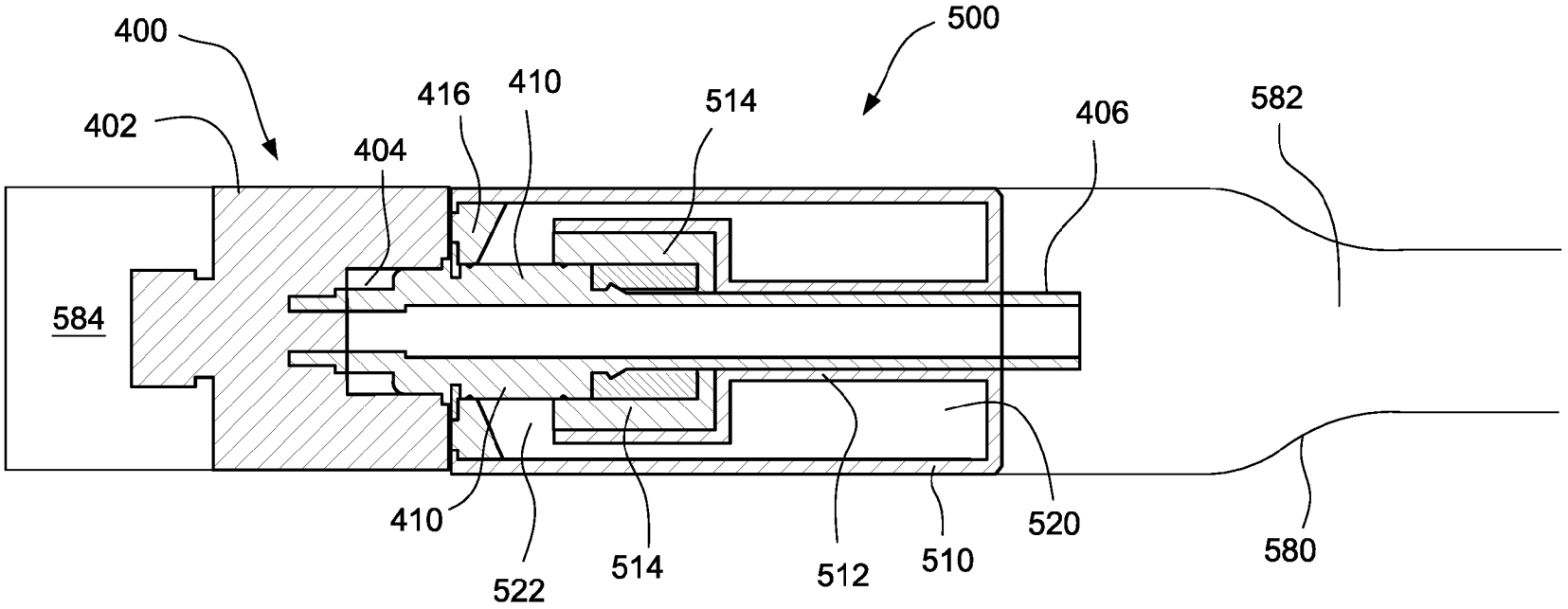
FIG. 6 is a schematic cross-sectional drawing of the third embodiment cartridge that is fully engaged to the atomizer with the seal located at the final position.

When the connector core 404 is fully engaged between the battery 584 and the mouthpiece 580 as shown in FIG. 6, the atomizer core 404 and conduit 406 can slide along the inner casing 512 of the cartridge 500 to extend through the cartridge to the opposite end that can connect to a mouthpiece. The seal 410 on the connector core 404 is engaged with a silicon stopper 514 that can be separately manufactured as a connecting or supporting portion of the inner casing 512 to engage the seal 410. The seal 410 and the silicon stopper 514 form a tight seal between the cartridge 500, the atomizer 400, and conduit 406. At the fully engaged position, a liquid intake on the connector core 404 is aligned with the liquid opening 522 of the cartridge 500. Liquid for vaporization is stored in the tank 520, and flows into the atomizer 400 when the atomizer 400 is fully engaged with the cartridge 500. Vapor can escape the atomizer 400 through the conduit 406, and into the mouthpiece opening 582.

Another silicon seal ring 516 may also be provided on the location of the cartridge 500 that would abut the atomizer base 402 when the atomizer 400 is fully engaged with the cartridge 500. The silicon seal ring 516 aids in providing a tight seal between the atomizer 400 and the cartridge 500 to avoid liquid leakage when the cartridge is engaged.

Figure 7A:
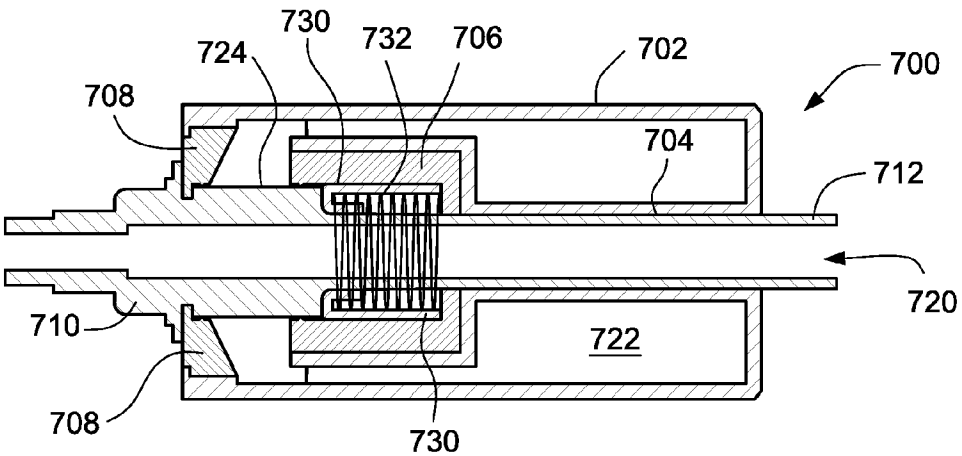
FIG. 7A is a schematic cross-sectional drawing of a fourth embodiment cartridge that is fully engaged to the atomizer with a spring loaded movable seal in the cartridge, and the spring is compressed to move the seal to the final position.
Figure 7B:
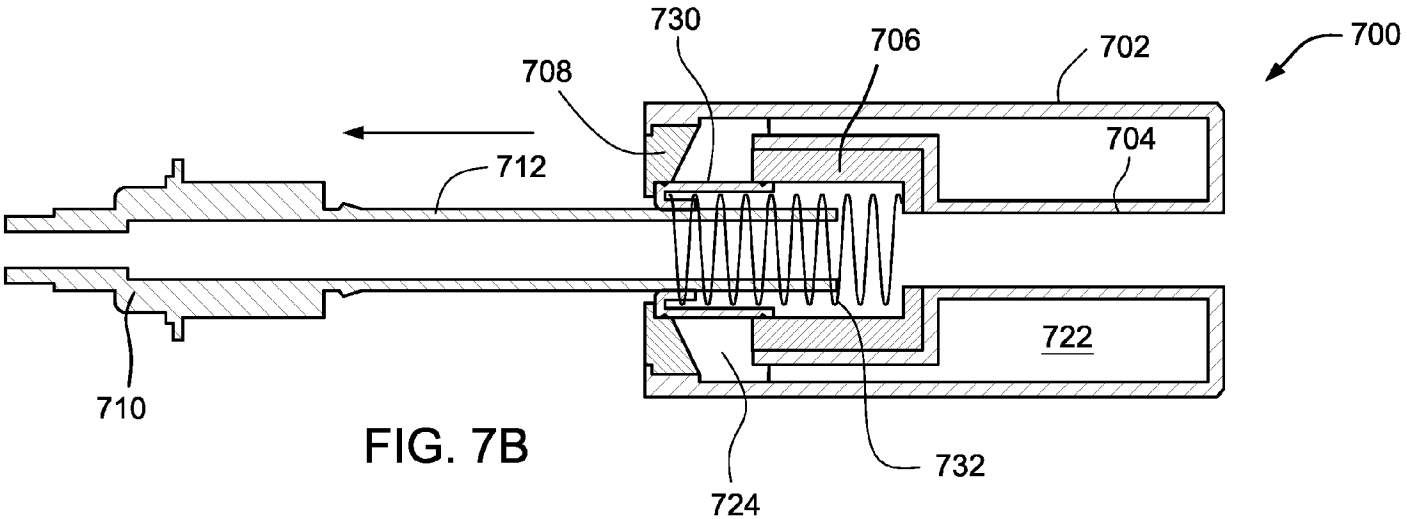
FIG. 7B is a schematic cross-sectional drawing of the fourth embodiment cartridge that is being removed from the atomizer, the spring loaded movable seal is fully released such that the seal is in the initial position.

FIGS. 7A and 7B shows another embodiment cartridge having a resealable trapdoor that uses a spring mechanism to position and displace a slider over the fluid opening to act as a seal when the cartridge is not in use, and to ensure a good fit between the cartridge, the connector core, and the conduit when the cartridge is fully engaged with the atomizer.

The cartridge 700 includes a resealable trapdoor that has a slider 730 and a spring 732. At the fully engaged position in FIG. 7A, the connector core 710 compresses the spring 732 such that the slider 730 is displaced from the liquid opening 724, and engages with the silicon seal 706 to form a tight seal. By engaging the slider 730 with the silicon seal 706, liquid will not leak during liquid transfer from the liquid opening 724 to a liquid intake passage on the atomizer core 710. The slider 730 is held in-place inside the cartridge 700 by an outer seal 708. Thus, liquid stored in the liquid storage 722 is only allowed to flow into the atomizer 710 for vaporization. The produced vapor escapes through the flow passage 720 that is defined by the conduit 712 attached to the atomizer.

When the atomizer core 710 is removed from the cartridge 700 for reasons such as replacing the cartridge 700, changing out the cartridge 700 for different flavored vapors, or replacing the atomizer core 710, the spring 732 is automatically released and the slider 730 moves to the initial closed position shown in FIG. 7B. At the initial closed position, the slider 730 acts as a seal for the cartridge that prevents fluid leakage from the liquid opening of the cartridge 700 when the cartridge is not engaged in a microvaporizer.

Figure 7C:
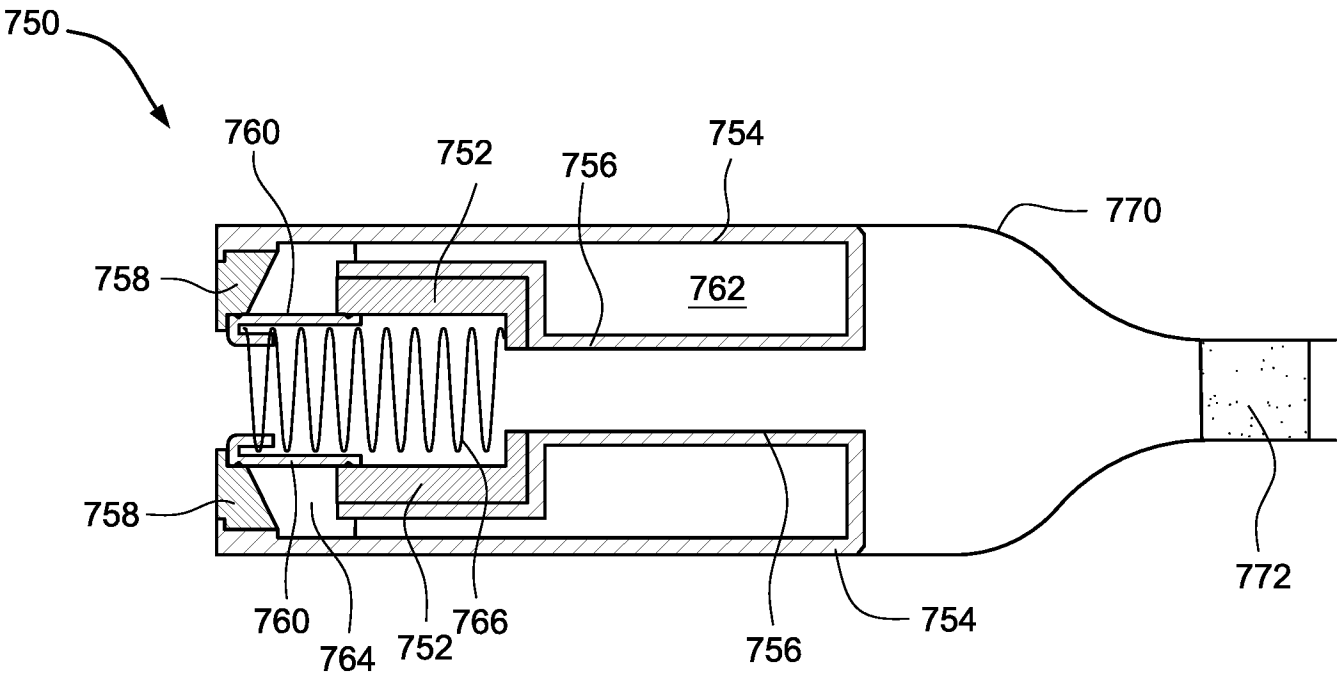
FIG. 7C is a schematic cross-sectional drawing of the fourth embodiment cartridge with a disposable mouthpiece attached.

FIG. 7C shows a disposable resealable cartridge 750 having an outer casing 754 and inner casing 756 to define a tank 762 between the outer casing 754 and an inner casing 756, and a mouthpiece 770 that is attached to the cartridge 750. The cartridge includes a seal 752 that supports a resealable trapdoor. The resealable trapdoor has a slider 760 that is operated by a spring 766 to prevent leakage of fluid from the tank 762. The slider 760 is held in-place inside the cartridge 750 by an outer seal 758. The mouthpiece 770 that is attached to the cartridge 750 can be detachable from the disposable cartridge, or can be attached with the cartridge as a single disposable apparatus. The mouthpiece 770 can include a filter 772 that filters the vapor before the vapor exits the mouthpiece 770.

Figure 8A:
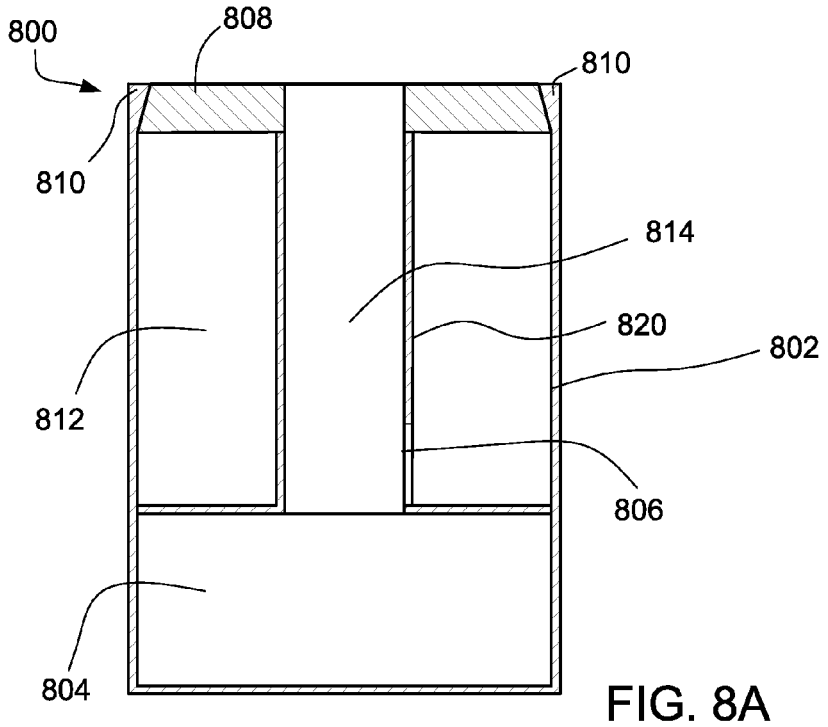
FIG. 8A is a schematic cross-sectional drawing of a fifth embodiment cartridge that includes a depressible plug.
Figure 8B:
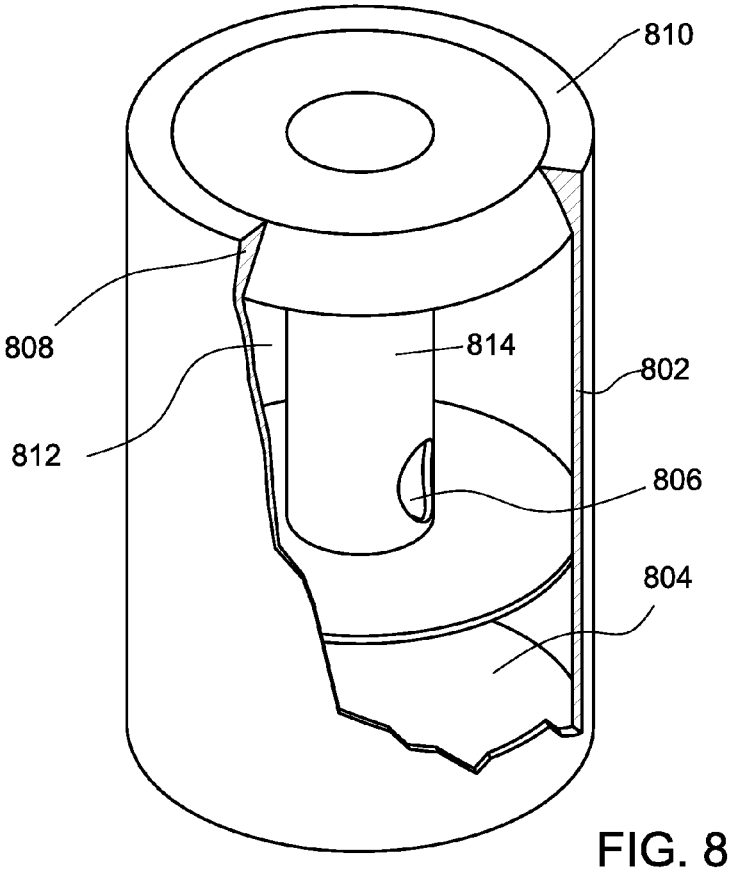
FIG. 8B is a schematic side view of the fifth embodiment cartridge with the depressible plug.

FIGS. 8A and 8B show a fifth embodiment cartridge 800 that includes a depressible plug 808. The depressible plug 808 is positioned over the tank 812 that is defined in between an outer casing 802 and an inner casing 820 on the top end of the cartridge 800. The tank 812 stores fluid, also called "e-juice", that can be released through a fluid opening 806 to be received by an atomizer. The atomizer can be fitted into the fluid intake chamber 804 on the bottom end of the cartridge 800. The inner casing is attached to the depressible plug 808, which is held inside the outer casing 802 via a ledge 810 on the top end of the outer casing 802. The depressible plug 808 is positioned along the inner perimeter of the outer casing 802 and the outer perimeter of the inner casing 820. The top surface of the plug 808 is positioned flush with the top end of the outer casing 802. The depressible plug 808 is donut shaped in this embodiment, and does not cover the through passage on the radially inner portion of the cartridge inside the inner casing 820. A plug of other shapes may also be employed so long as the tank 812 is sealed adequately.

Figure 8C:
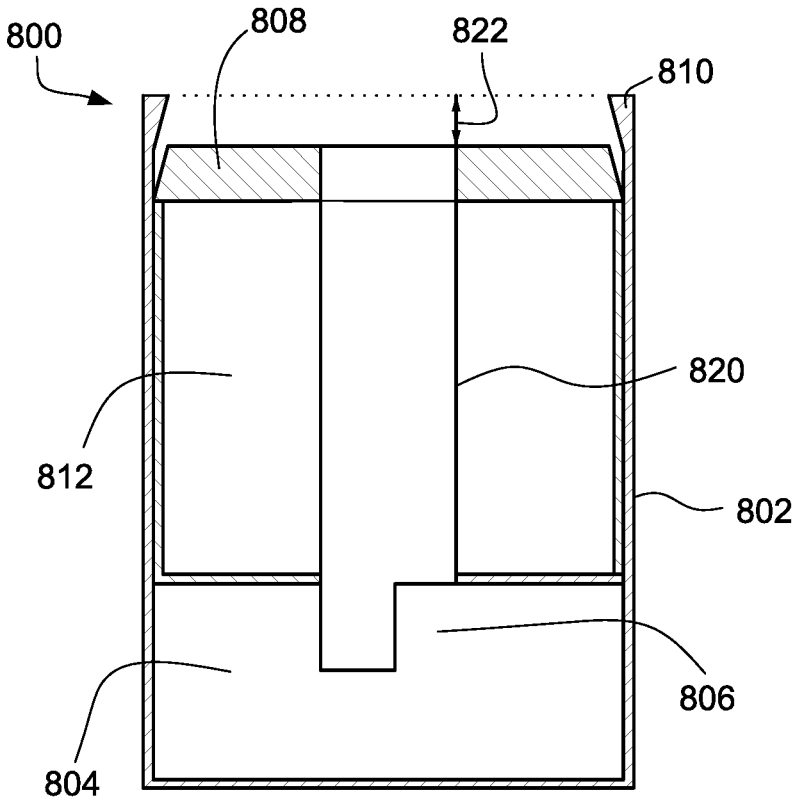
FIG. 8C is a schematic drawing of the fifth embodiment cartridge with the depressible plug engaged in a depressed position.

The fluid intake chamber 804 is connected to the vapor conduit 814 that is defined by the inner surface of the inner casing 820. As shown in FIG. 8C, when the depressible plug 808 is engaged, the plug 808 is depressed into the cartridge 800 to push the fluid opening 806 downwards into the fluid intake chamber 804. The depressible plug 808 would have a displacement height 822 away from the initial position that is flush with the top end of the outer casing 802. The plug 808 can be automatically resealed upon disengagement by allowing the depressible plug 808 to be released back to its initial position at the top end of the outer casing 802 as shown in FIGS. 8A and 8B.

Figure 9A:
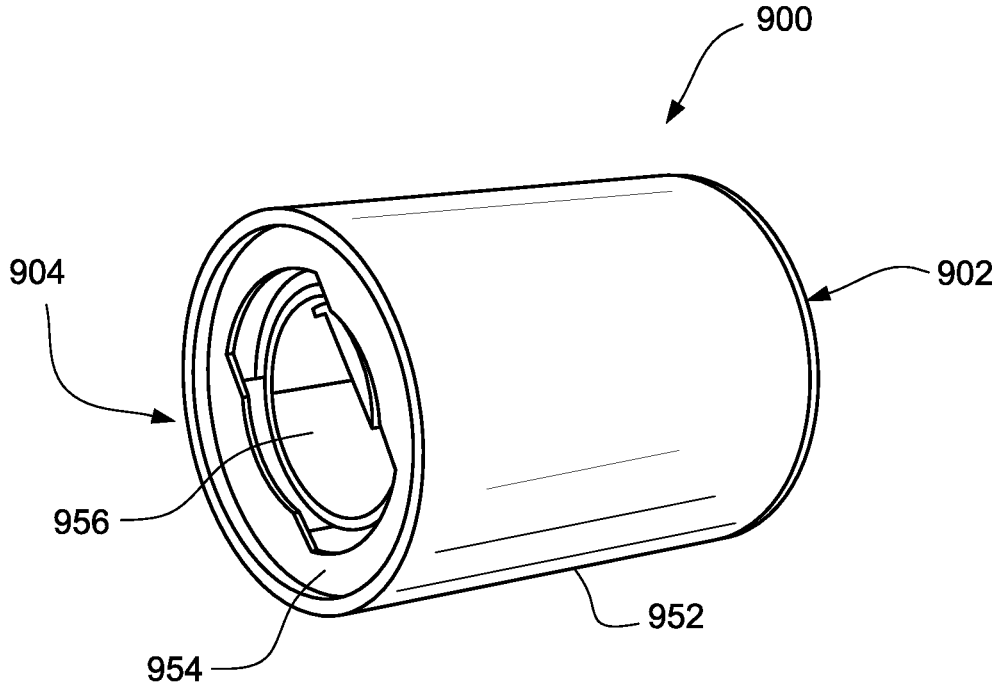
FIG. 9A is a close-up side view of a sixth embodiment cartridge.
Figure 9B:
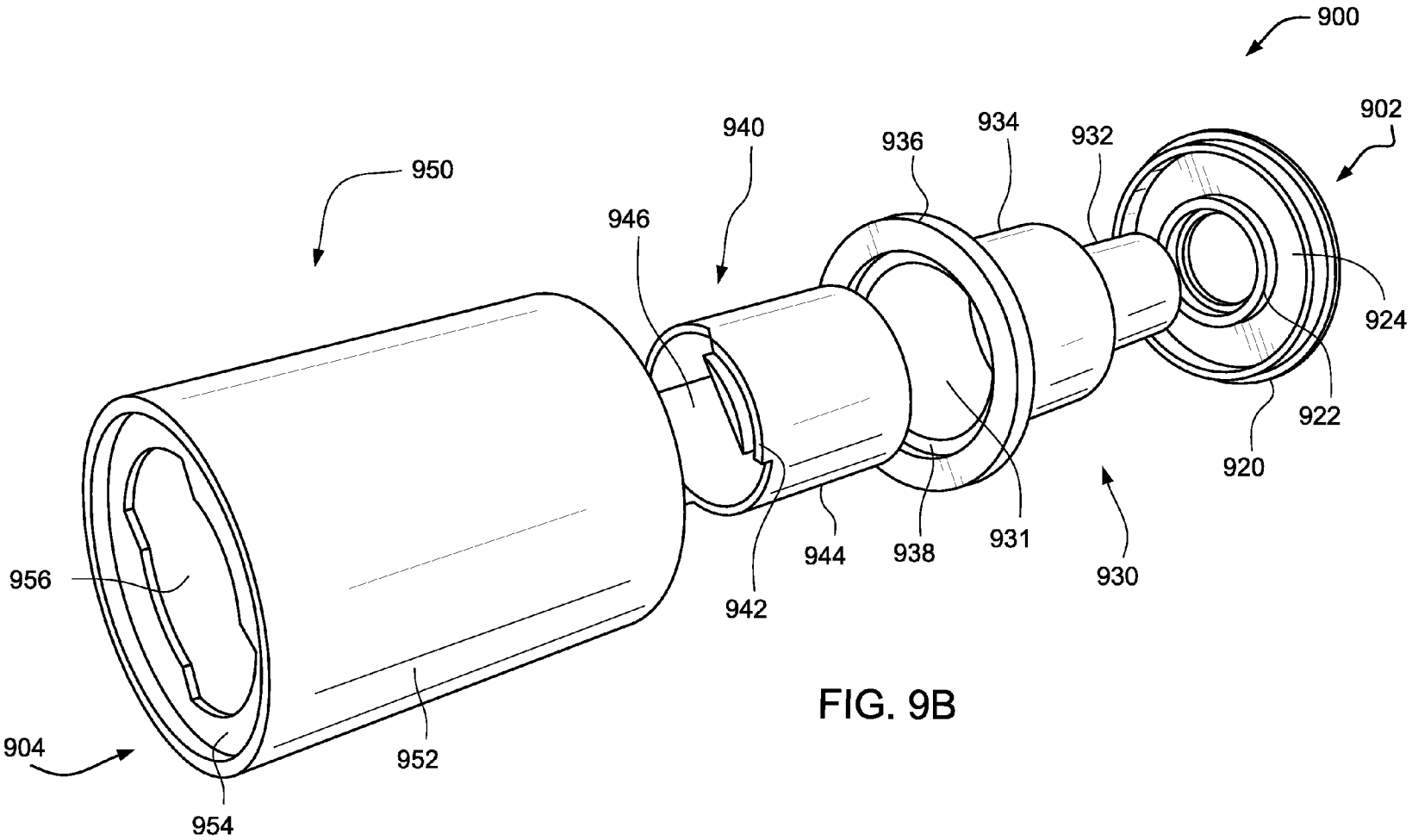
FIG. 9B is a blow-up view of the sixth embodiment cartridge showing all of the components separately.
Figure 9C:
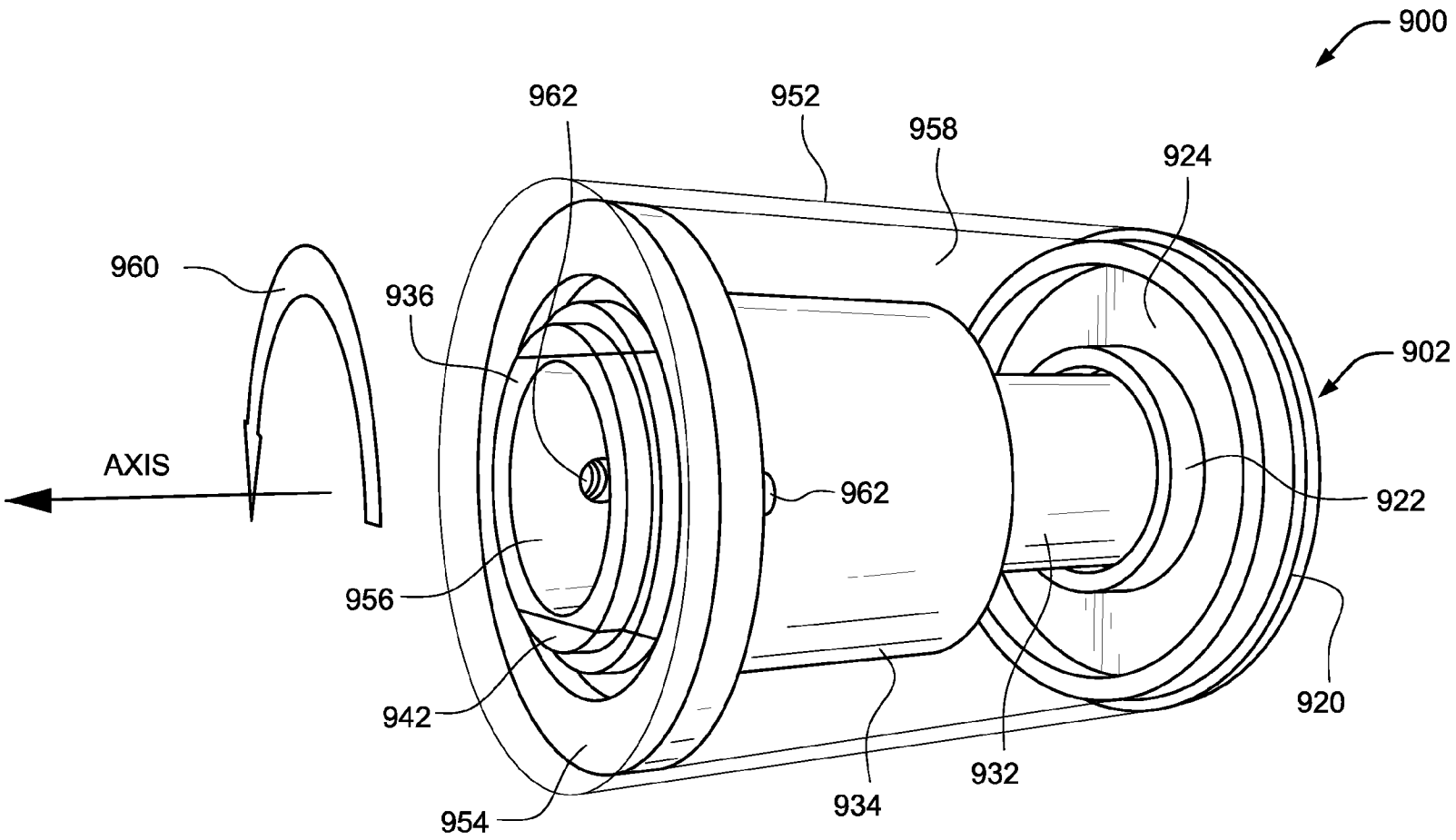
FIG. 9C is a schematic drawing of the sixth embodiment cartridge with transparency through the cartridge outer casing, denoting the locking direction of the lock-and-twist mechanism.

A sixth embodiment cartridge is shown in detail in FIGS. 9A, 9B and 9C. The cartridge 900 includes an outer casing 950 that has an external surface 952, and a set of grooves 954 at the bottom end 904 of the cartridge 900. The outer casing 950 also includes a through passage 956 that houses a twist-lock trapdoor 940, an inner casing 930, and a seal 920 at the top end 902 of the cartridge 900. A tank 958 for liquid storage is defined between the outer casing 950 and the inner casing 930, and the tank 958 is sealed off on the top end by the seal 920.

The trapdoor 940 is situated inside the inner casing 940, such that the radially outer surface 944 of the trapdoor 940 abuts the radially inner surface 931 of the inner casing 930, and the trapdoor 940 is positioned over a fluid opening 962 in the inner casing 930. The trapdoor 940 inserts into the inner casing passage 931 to be engaged with a modified atomizer. The inner casing 930 is formed in a shape that is able to receive a conduit portion from the modified atomizer unit. For example, the inner casing 930 has a lip 936 that engages with the outer casing 950, a first section 934 that receives the trapdoor 940 and a wide base of the conduit on a modified atomizer unit, and a second section 932 that receives the elongated conduit of the modified atomizer unit.

The seal 920 on the second end 902 of the cartridge 900 can include a groove 922 to ensure that the cartridge 900 is well sealed around the second section 932 of the cartridge 900.

Figure 10A:
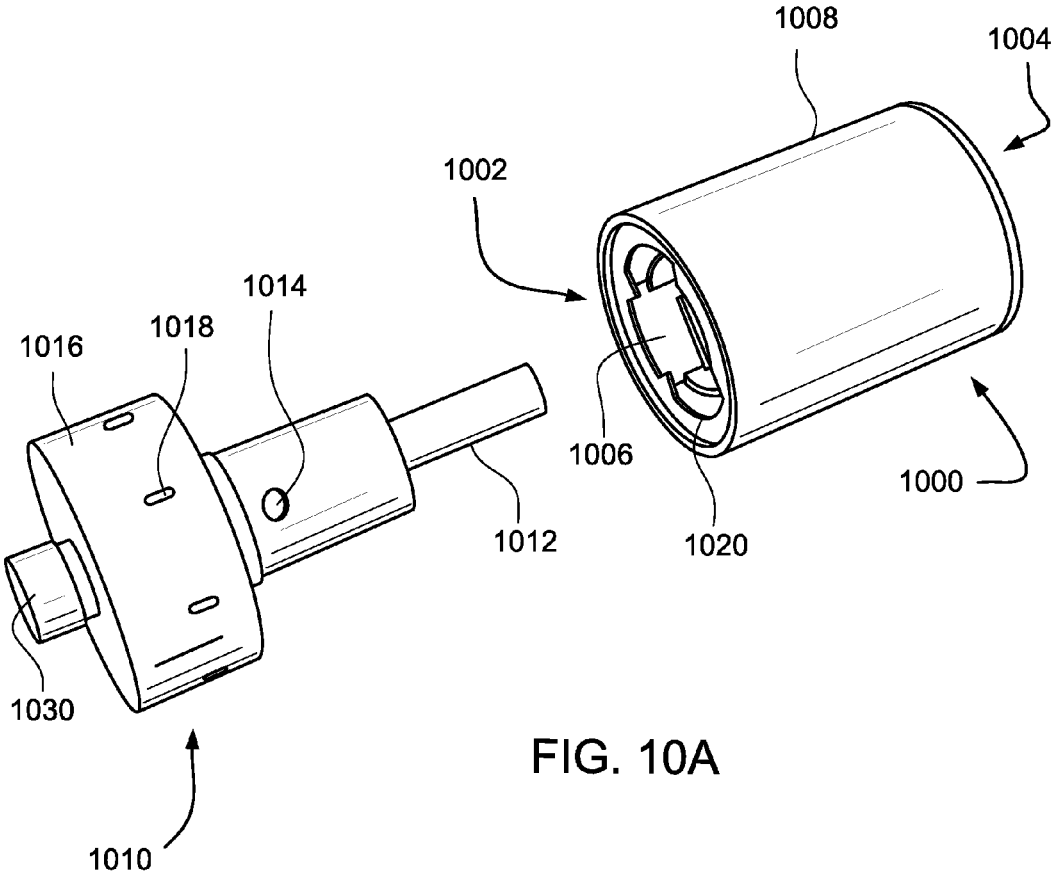
FIGS. 10A, 10B, and 10C illustrates insertion process of a modified atomizer to the sixth embodiment cartridge using a lock-and-twist mechanism, denoting the twist direction that aligns the fluid opening on the inner casing to the fluid intake of the atomizer.
Figure 10B:
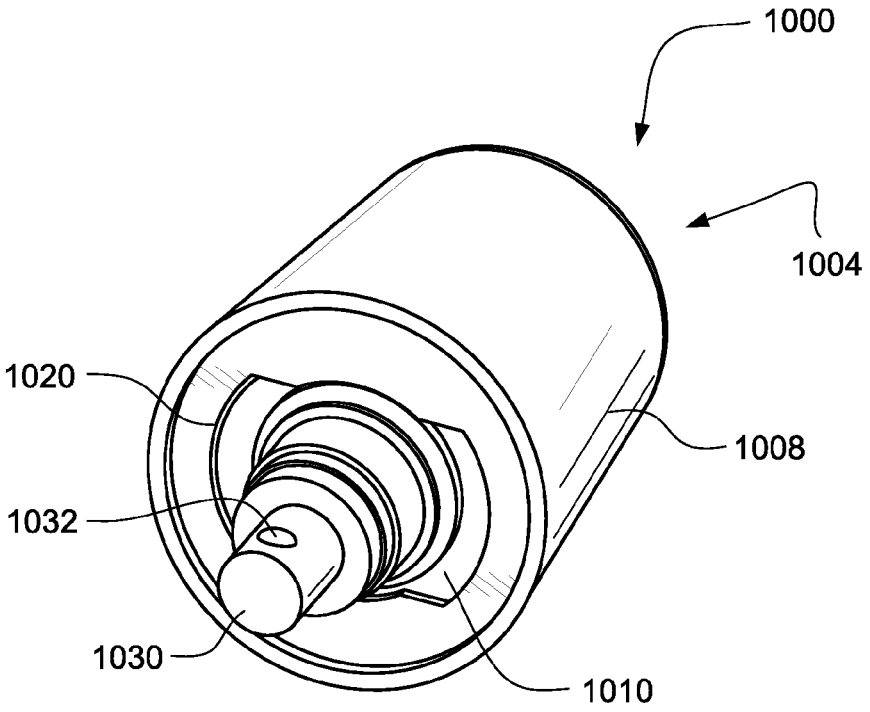
Figure 10C:
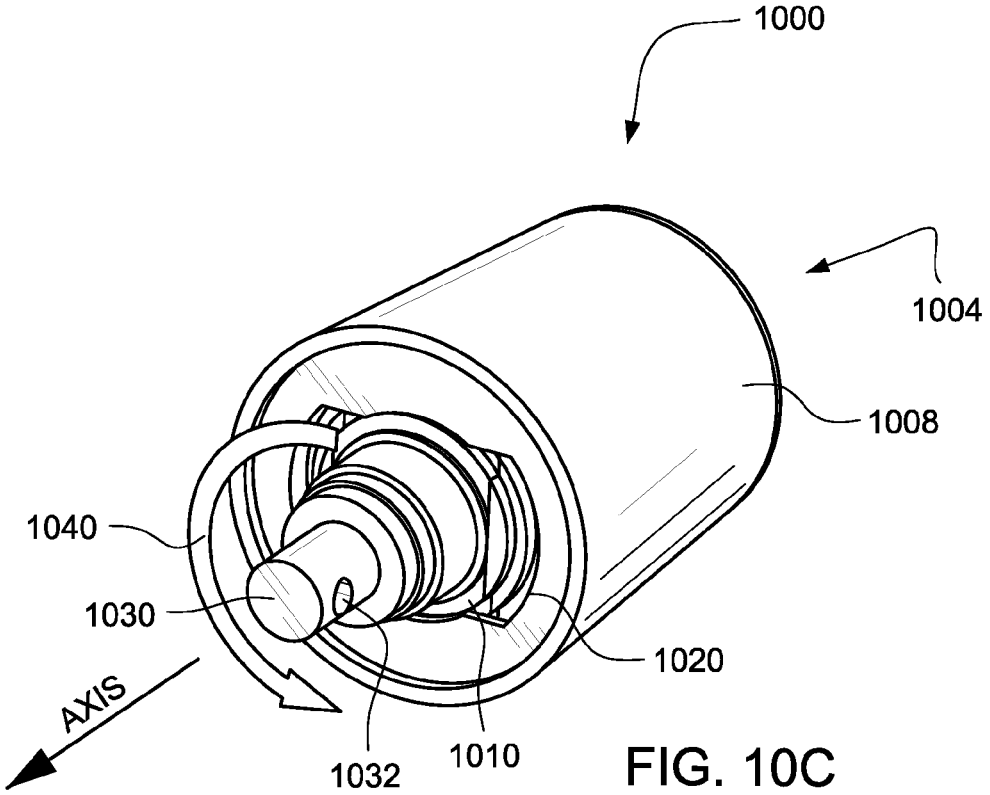

Standing alone, the fluid opening 962 of the cartridge 900 is sealed by the trapdoor 934 by a misalignment of the opening on the trapdoor 934 from the fluid opening 962 in the inner casing 930. When the cartridge 900 is engaged with a modified atomizer, an applicable mechanism on the atomizer can be aligned with the receivable mechanism, such that the trapdoor 934 is twisted in a first direction 960 in a circumferential direction with respect to the axis of the cartridge 900, thus enables the fluid opening 962 to align with fluid intake holes on an atomizer unit, which receives the fluid stored in the tank 958 into the atomizer unit. The engagement process of the twist-lock mechanism is shown in FIGS. 10A, 10B and 10C.

The cartridge 1000 can be connected with a modified atomizer unit 1010 that includes an atomizer inside a conduit 1012, and connected to the base 1016. The conduit 1012 of the atomizer unit 1010 has a fluid opening 1014 and at least one air intake 1018 on the base 1016. The cartridge 1000 includes a bottom end 1002 that receives the atomizer unit 1010, and a top end 1004 that is enclosed by a seal on the outer casing 1008 or can be attached directly to a disposable mouthpiece as a single commercial unit.

The atomizer unit 1010, particularly in the conduit portion 1012, is shaped to fit into the inner casing 1020 of the cartridge 1000 to engage the trapdoor 1006 provided on the inner surface of the inner casing 1020. The atomizer unit 1010 also has a handle 1030 on the bottom end, opposite of the conduit 1012, that allows a user to hold onto the atomizer unit as the user inserts the atomizer unit 1010 into the bottom end 1002 of the cartridge 1000 and engages the twist-lock mechanism.

The lock-and-twist mechanism is activated by inserting the conduit 1012 of a modified atomizer unit 1010 into a cartridge 1000. As the atomizer unit 1010 is inserted into the cartridge 1000, shown in FIGS. 10B and 10C, the atomizer unit fits into the particular shape of the inner casing 1020, for example, having a flat surface on inner casing that is otherwise cylindrical, and the user is able to twist the atomizer unit 1010 in a circumferential direction 1040 along the axis of the cartridge 1000 to engage the twist-lock and align the fluid openings. The engagement of the parts performs as a twist-lock mechanism such that a fluid opening in the cartridge 1000 is aligned with a fluid intake on the atomizer unit 1010. The atomizer unit 1010 can optionally have a through passage 1032 across the diameter of the handle 1030 to allow a rod to slide into the through passage 1032 for additional leverage in performing the twist-lock mechanism.

To disengage the modified atomizer unit from the cartridge, the lock-and-twist mechanism is deactivated by twisting the mechanism in the reverse direction from the circumstantial direction 1040 to misalign the fluid opening 1364 and the opening 1324. The trapdoor 1340 automatically reseals the openings during the twist to prevent fluid leakage. Disengaged, the resealable cartridge can be switched out of a microvaporizer for a user to change vapor flavors, or can be stored separately from the microvaporizer, and still retain the remaining fluid stored in the tank without leakage.

Disposable cartridges described may be adjusted to fit different brands and types of microvaporizers by changing the diameter of the cartridge and the length of the cartridge along the axis, and the size and shape of the inner casing of the cartridge. To ensure a good fit between the cartridges and the different types of microvaporizers, silicon seals, movable seals, and other connectors may be manufactured or retrofitted from the microvaporizers as described. Additionally, multiple fluid openings in different shapes and sizes can be provided in the cartridges to align with the number of fluid openings on the atomizers in the commercial microvaporizers.

All of the described exemplary cartridges allow the user to refill a microvaporizer quickly by providing a single disposable resealable cartridge that can be replaced quickly and accurately. The cartridges can be made, or retrofitted with supporting parts, to accommodate and connect to the different brands and types of microvaporizers. The seals in the cartridges are also optimized in shapes and sizes to be fully positioned over the fluid openings in the cartridges.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A microvaporizer engaged with a resealable disposable cartridge, comprising:

a battery;

an atomizer operatively attached to the battery;

a mouthpiece; and a disposable resealable cartridge operatively connected to the atomizer on a first end, and operatively connected to the mouthpiece on a second end, the cartridge comprising an outer casing, an inner casing, a tank defined by a radially inner surface of the outer casing and a radially outer surface of the inner casing, a liquid opening on the inner casing, and a resealable trapdoor that is positioned over the liquid opening.

2. The microvaporizer of claim 1 wherein the resealable trapdoor is located on the radially inner surface of the inner casing and acts as a seal on the liquid opening.

3. The microvaporizer of claim 1 further comprising an atomizer base that is attached to the atomizer, and may include at least one air intake opening.

4. The microvaporizer of claim 1, wherein the resealable trapdoor is a lock-and-twist mechanism.

5. The microvaporizer of claim 1 wherein the resealable trapdoor includes a slider and a spring located radially inwards of the slider.

6. The microvaporizer of claim 5, wherein the atomizer compresses the spring to move the slider away from the liquid opening when the atomizer is engaged with the resealable disposable cartridge.

7. The microvaporizer of claim 6, wherein the spring on the resealable trapdoor is automatically resealed to allow the slider to be positioned over the liquid opening when the atomizer is disengaged from the resealable disposable cartridge.

8. The microvaporizer of claim 4, wherein the resealable trapdoor opens as the disposable cartridge is twist-locked onto the atomizer in a first direction, and the resealable trapdoor closes as the disposable cartridge is unlocked from the atomizer by a twist motion in a second direction.

9. The microvaporizer of claim 1, wherein the inner casing of the cartridge is shaped to allow the atomizer to attach to a radially inner surface of the inner casing, and a liquid intake of the atomizer is in line with the liquid opening in the inner casing.

10. A disposable microvaporizer cartridge, comprising:

an outer casing having a first end and a second end;

an inner casing provided radially inwards of the outer casing, having a first end and a second end that corresponds with the outer casing;

a fluid opening on the second end of the inner casing;

a tank defined between a radially inward surface of the outer casing and a radially outward surface of the inner casing, the tank having a first end that is enclosed and a second end that includes the fluid opening; and a resealable trapdoor positioned over the fluid opening.

11. The disposable microvaporizer cartridge of claim 10, wherein the resealable trapdoor includes a slider attached to a spring, the slider portion seals the fluid opening.

12. The disposable microvaporizer cartridge of claim 10, wherein the resealable trapdoor is a lock-and-twist mechanism.

13. The disposable microvaporizer cartridge of claim 10 further comprising a disposable mouthpiece that is provided on the first end of the disposable microvaporizer cartridge.

14. The disposable microvaporizer cartridge of claim 10, wherein the inner casing of the cartridge is shaped to allow an atomizer to attach to a radially inner surface of the inner casing, and a liquid intake of the atomizer is in line with the liquid opening in the inner casing.

* * * * *